US006705551B1

(12) United States Patent
Kienzler et al.

(10) Patent No.: US 6,705,551 B1
(45) Date of Patent: Mar. 16, 2004

(54) COMMON RAIL INJECTOR

(75) Inventors: Dieter Kienzler, Leonberg (DE); Patrick Mattes, Stuttgart (DE); Wolfgang Stoecklein, Stuttgart (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 183 days.

(21) Appl. No.: 09/806,697

(22) PCT Filed: Aug. 2, 2000

(86) PCT No.: PCT/DE00/02580

§ 371 (c)(1),
(2), (4) Date: Sep. 5, 2001

(87) PCT Pub. No.: WO01/11222

PCT Pub. Date: Feb. 15, 2001

(30) Foreign Application Priority Data

Aug. 4, 1999 (DE) ..... 199 36 668

(51) Int. Cl.[7] ..... F02M 39/00; F02M 59/00; F02M 47/02; B05B 1/30

(52) U.S. Cl. ..... 239/533.3; 239/533.2; 239/89; 239/533.9; 239/533.11; 239/588.5

(58) Field of Search ..... 259/88, 89, 91, 259/92, 533.2, 533.3, 533.8, 533.9, 533.11, 585.1, 585.3, 585.4, 585.5; 251/129.15, 129.21, 127

(56) References Cited

U.S. PATENT DOCUMENTS

| | | | | |
|---|---|---|---|---|
| 4,572,433 A | | 2/1986 | Deckard | |
| 4,826,080 A | | 5/1989 | Ganser | |
| 5,464,156 A | | 11/1995 | Ricco et al. | |
| 5,472,142 A | * | 12/1995 | Iwanaga | 239/96 |
| 5,542,610 A | * | 8/1996 | Augustin | 239/533.8 |
| 5,685,483 A | | 11/1997 | Ganser | |
| 5,779,149 A | * | 7/1998 | Hayes, Jr. | 239/124 |

FOREIGN PATENT DOCUMENTS

| | | |
|---|---|---|
| EP | 0 385 398 A2 | 2/1990 |
| EP | 0 385 399 A2 | 2/1990 |
| GB | 2 065 772 A | 12/1980 |

* cited by examiner

*Primary Examiner*—Davis Hwu
(74) *Attorney, Agent, or Firm*—Ronald E. Greigg

(57) ABSTRACT

The invention relates to a common rail fuel injector having an injector housing with a fuel inlet in communication with a central high-pressure fuel reservoir outside the injector housing and with a pressure chamber inside the injector housing. A control valve assures that a nozzle needle lifts from a seat when the pressure in the pressure chamber is greater than the pressure in a control chamber that communicates with the fuel inlet via an inlet throttle. The control chamber is defined by a bush that is displaceable, causing a sealing action, on the end of the nozzle needle remote from the combustion chamber and that is kept in contact against the injector housing with the aid of the nozzle spring.

20 Claims, 8 Drawing Sheets

COMMON RAIL INJECTOR

CROSS-REFERENCE TO RELATED APPLICATIONS

This application is a 35 USC 371 application of PCT/DE 00/02580 filed on Aug. 2, 2000.

BACKGROUND OF THE INVENTION

1. Field of the Invention

The invention relates to a common rail injector for injecting fuel in a common rail injection system of an internal combustion engine, which system has an injector housing with a fuel inlet that is in communication with a central high-pressure fuel reservoir outside the injector housing and with a pressure chamber inside the injector housing, from which fuel subjected to high pressure is injected as a function of the position of a control valve that assures that a nozzle needle movable back and forth and received in a longitudinal bore of the injector axially counter to the prestressing force of a nozzle spring that is received in a nozzle spring chamber, lifts from a seat when the pressure in the pressure chamber is greater than the pressure in a control chamber that communicates with the fuel inlet via an inlet throttle.

2. Description of the Prior Art

In common rail injection systems, a high-pressure pump pumps the fuel into the central high-pressure fuel reservoir, which is called a common rail. From the high-pressure fuel reservoir, high-pressure lines lead to the individual injectors, which are assigned to the engine cylinders. The injectors are triggered individually by the engine electronics. The rail pressure prevails in the pressure chamber and at the control valve. When the control valve opens, fuel subjected to high pressure reaches the combustion chamber, past the nozzle needle that is lifted counter to the prestressing force of the nozzle spring.

In conventional injectors of the kind known for instance from German Patent Disclosures DE 197 24 637 A1 or DE 197 32 802 A1, relatively long nozzle needles are used. In operation, because of the high pressures and the rapid load changes, very strong forces act on the nozzle needle. These forces cause the nozzle needle to be stretched and compressed in the longitudinal direction. This in turn means that the nozzle needle stroke varies as a function of the forces acting on the nozzle needle.

SUMMARY OF THE INVENTION

The object of the invention is to furnish a common rail injection system with a small structural volume that is simple in design and can be produced economically. In particular, even at a high nozzle needle speed, good closing performance should be assured.

In a common rail injector for injecting fuel in a common rail injection system of an internal combustion engine, which system has an injector housing with a fuel inlet that is in communication with a central high-pressure fuel reservoir outside the injector housing and with a pressure chamber inside the injector housing, from which fuel subjected to high pressure is injected as a function of the position of a control valve that assures that a nozzle needle movable back and forth and received in a longitudinal bore of the injector axially counter to the prestressing force of a nozzle spring that is received in a nozzle spring chamber, lifts from a seat when the pressure in the pressure chamber is greater than the pressure in a control chamber that communicates with the fuel inlet via an inlet throttle, this object is attained in that the control chamber is defined by a bush that is displaceable, causing a sealing action, on the end of the nozzle needle remote from the combustion chamber and that is kept in contact against the injector housing with the aid of the nozzle spring. The bush offers the advantage that the control chamber and the nozzle spring chamber can be combined on the end remote from the combustion chamber of the nozzle needle, without the volume of the control chamber depending on the structural space of the nozzle spring. It is therefore possible to build in a nozzle spring with high spring rigidity, which assures good closure of the nozzle needle. As a result, the injection time and the instant of injection can be defined exactly. Furthermore, the control chamber can be made quite small, which leads to a rapid response behavior of the injector of the invention. There is also a relationship between the maximum attainable nozzle needle speed and the nozzle needle diameter. To achieve elevated nozzle needle speeds, which is important especially upon needle closure, the nozzle needle diameter must be reduced. For a closing speed of 1 m/s, a needle diameter below 3.5 mm is required, for an acceptable control quantity. This is technologically quite complicated and therefore expensive. According to the present invention, the nozzle needle diameter can be selected freely and is not dependent on the dimensions of the nozzle spring. In comparison to convention nozzle needles, the length can be reduced considerably, which contributes to an exact stroke stop.

One particular type of embodiment of the invention is characterized in that a biting edge is embodied on the face of the bush that is in contact with the injector housing. As a result, it is attained that the control chamber embodied in the interior of the bush remains separated from the nozzle spring chamber that surrounds the bush.

A further particular type of embodiment of the invention is characterized in that the inside diameter of the bush is less than or equal to a guide diameter at the nozzle needle. The smaller the control chamber volume can be selected to be, the more readily the injector reacts. According to the present invention, the inside diameter of the bush and the corresponding outside diameter at the nozzle needle can be made much smaller than in conventional injectors.

Another particular type of embodiment of the invention is characterized in that the fuel inlet communicates with the pressure chamber via the nozzle spring chamber, and that the nozzle needle is guided between the nozzle spring chamber and the pressure chamber. This offers the advantage that the nozzle needle guide no longer has any sealing function. This makes the demands in terms of quality of the guide less stringent, leading to economies in production. Since the same pressure prevails on both sides of the guide, guide leakage no longer occurs.

A further particular type of embodiment of the invention is characterized in that the nozzle spring chamber communicates with the pressure chamber via a bore. As a result, the entire circumference of the nozzle needle can be utilized for guide purposes.

A further particular type of embodiment of the invention is characterized in that at least one flat face, past which fuel from the nozzle spring chamber can reach the pressure chamber, is embodied on the nozzle needle between the nozzle spring chamber and the pressure chamber. This type of embodiment offers advantages especially with regard to the high-pressure strength.

Further particular types of embodiment of the invention are characterized in that the inlet throttle is integrated with the bush, the nozzle needle or the injector housing. The inlet throttle serves to prevent pressure surges in operation.

A further particular type of embodiment of the invention is characterized in that the bush has a collar on its end remote from the combustion chamber. The collar forms a first abutment for the nozzle spring.

A further particular type of embodiment of the invention is characterized in that a step that forms a stop for a spring plate is formed on the nozzle needle. The spring plate forms a second abutment for the nozzle spring.

A further particular type of embodiment of the invention is characterized in that a circumferential groove is recessed out of the nozzle needle, and in this groove a retaining ring which forms a stop for a spring plate is braced. In this type of embodiment, the outside diameter of the nozzle needle in the control chamber and the guide diameter of the nozzle needle between the nozzle spring chamber and the pressure chamber can be the same size. This is advantageous in production, for instance by means of lapping.

A further particular type of embodiment of the invention is characterized in that the retaining ring is in two parts, and in the assembled state it is fixed by the spring plate. As a result, loosening of the spring plate in operation is prevented in a simple way.

A further particular type of embodiment of the invention is characterized in that the nozzle needle stroke is defined by the spacing between the bush and the spring plate. This purely mechanical nozzle needle stroke end stop offers the advantage that the nozzle needle stroke is exactly replicable. As a result, the course of injection can be shaped reliably. So-called hydraulic sticking is avoided.

A further particular type of embodiment of the invention is characterized in that the nozzle needle stroke and the nozzle spring prestressing can be adjusted with the aid of spacer elements, which are disposed between the spring plate and the stop for the spring plate, and between the nozzle spring and the abutments for the nozzle spring. As a result, the closing performance of the injector can be improved.

A further particular type of embodiment of the invention is characterized in that the nozzle needle stroke is defined by the spacing between the end face, remote from the combustion chamber, of the nozzle needle and the injector housing. This type of embodiment has the advantage of being especially simple to achieve in terms of production technology.

A further particular type of embodiment of the invention is characterized in that recesses, whose dimensions are adapted to the volume of the control chamber, are provided in the end face, remote from the combustion chamber, of the nozzle needle and/or in the opposed face of the injector housing. In order in injector operation to achieve the most linear possible quantity performance graph, it is useful not to embody the nozzle needle stroke purely hydraulically. In a purely hydraulic nozzle needle stroke stop, it can happen that the nozzle needle "floats" on a pressure cushion in the open position. This can cause vibration of the nozzle needle. The vibration in turn leads to nonlinear quantity performance graphs. Since this is a dynamic motion, the result is a greater tolerance dependency. The vibration of the nozzle needle can depend on the inlet throttle and the outflow throttle, the friction of the nozzle needle guide, the control chamber volume, and so forth. In a purely mechanical stop, although vibration of the nozzle needle is indeed avoided, still a somewhat greater control quantity is required for the purpose. This has an unfavorable effect on the efficiency of the injector. The recesses, which can for instance take the form of cross-shaped slots, creates a "semi-hydraulic" stop. The flow cross section that remains upon impact is selected to be precisely large enough that while vibration of the nozzle needle is avoided, still the control quantity at the end stop is lowered as far as possible. In this respect it is advantageous that the injector of the invention has no leakage; that is, without triggering of the injector, no return quantity is generated.

A further particular type of embodiment of the invention is characterized in that in the end face, remote from the combustion chamber, of the nozzle needle at least one axial bore is provided, which communicates with at least one radial bore in the nozzle needle. This type of embodiment has the advantage of being insensitive to mechanical running-in; that is, the flow cross section does not change over the service life.

BRIEF DESCRIPTION OF THE DRAWINGS

Further advantages, characteristics and details of the invention will become apparent from the ensuing description, in which various exemplary embodiments of the invention are described in detail in conjunction with the drawings, in which.

DESCRIPTION OF THE PREFERRED EMBODIMENTS

Figure 1:
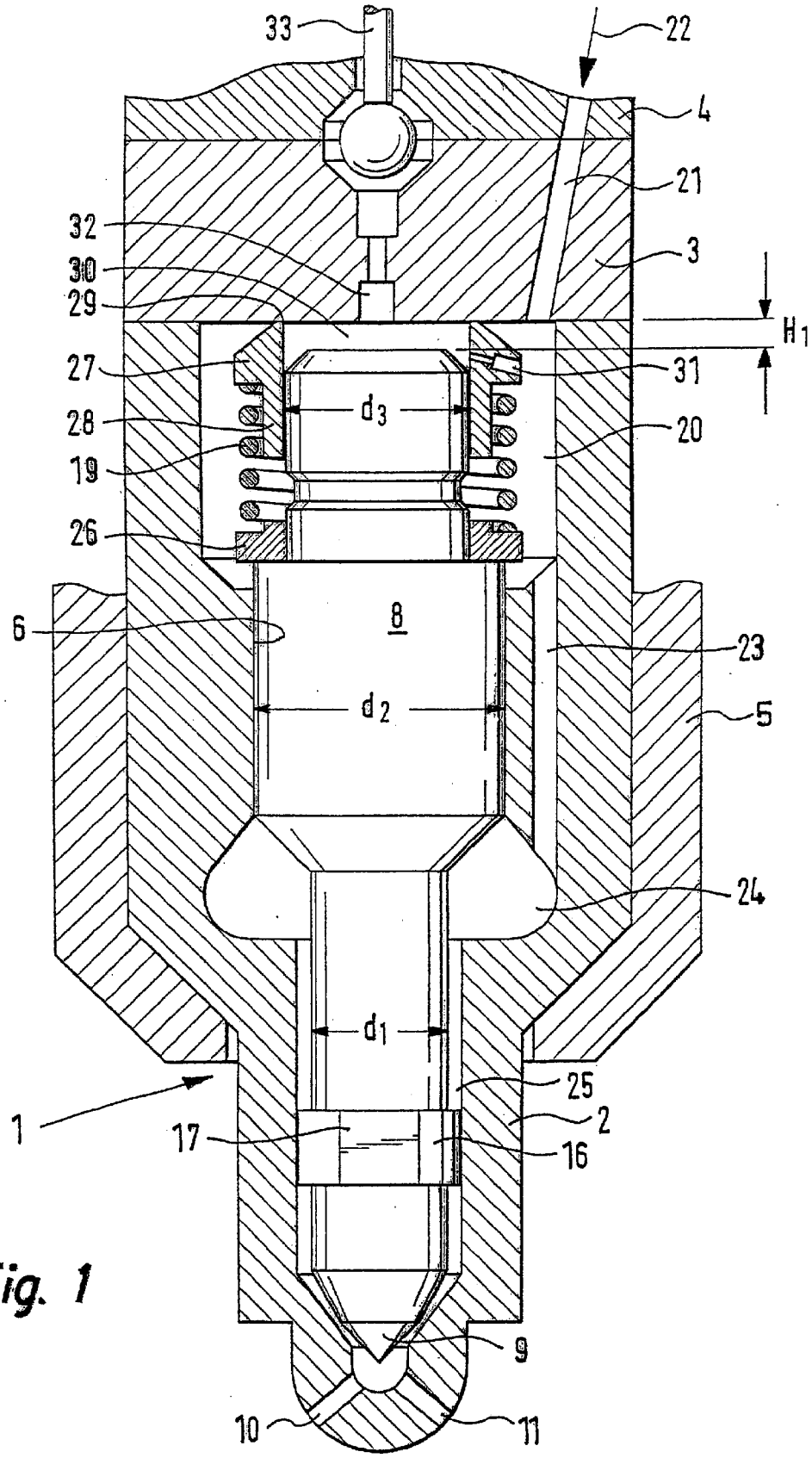
FIG. 1 is a fragmentary sectional view of a first exemplary embodiment of the injector with a bore between the nozzle spring chamber and the pressure chamber.

The first exemplary embodiment of the injector of the invention, shown in longitudinal section in FIG. 1, has an injector housing identified overall by reference numeral 1. The injector housing 1 includes a nozzle body 2, which protrudes with its lower, free end into the combustion chamber of the internal combustion engine to be supplied. With its upper end face, remote from the combustion chamber, the nozzle body 2 is axially braced by a lock nut 5 against a valve body 3 and an injector body 4.

An axial guide bore 6 is recessed out of the nozzle body 2. A nozzle needle 8 is guided axially displaceably in the guide bore 6. A sealing face is embodied on the tip 9 of the nozzle needle 8, and this face cooperates with a sealing seat that is embodied on the nozzle body 2. When the tip 9 of the nozzle needle 8 is located with its sealing face in contact with the sealing seat, two injection ports 10 and 11 in the nozzle body 2 are closed. When the nozzle needle tip 9 lifts from its seat, fuel subjected to high pressure is injected through the injection ports 10 and 11 into the combustion chamber of the engine.

Beginning at the tip 9, the nozzle needle 8 has three regions of different diameters $d_1$, $d_2$ and $d_3$. The diameter $d_2$ is the largest and serves to guide the nozzle needle 8 in the nozzle body 2. The diameter $d_1$ is the smallest. In the portion having the diameter $d_1$, a collar 16 with a flat face 17 is embodied on the outer circumferential surface of this portion. The collar 16 forms a second guide for the nozzle needle 8. By means of the flat face 17 in the collar 16, a flow connection is made possible in the longitudinal direction of the nozzle needle 8 from one side of the collar 16 to the other. The diameter $d_3$ is larger than the diameter $d_1$ but smaller than the diameter $d_2$. The diameter $d_3$ is also the diameter of the control diameter.

The nozzle needle 8 is prestressed against the nozzle needle seat in the region of the injection ports 10 and 11 with the aid of a nozzle spring 19. The nozzle spring 19 is disposed in a nozzle spring chamber 20, into which a fuel inlet 21 discharges. An arrow 22 indicates that the fuel inlet 21 is supplied from a rail (not shown) with fuel that is subjected to high pressure. Via a bore 23, the fuel subjected to high pressure flows out of the nozzle spring chamber 20 into a pressure chamber 24. The pressure chamber 24 communicates with the injection ports 10 and 11 via an annular chamber 25, when the nozzle needle 8 has lifted from its seat counter to the prestressing force of the nozzle spring 19.

Because of the difference in size between the diameter $d_2$ and the $d_3$, a step is created on the nozzle needle 8, which forms a stop for a spring plate 26. Via the spring plate 26, the prestressing force of the nozzle spring 19 is transmitted to the nozzle needle 8. The other end of the nozzle spring 19 is braced against a collar 27, which is embodied on a bush 28. The inside diameter of the bush 28 is slightly greater than the control diameter $d_3$ of the nozzle needle 8. The respective diameters are selected such that the bush 28 is displaceable relative to the nozzle needle 8, with a sealing effect. As a consequence of the prestressing force of the nozzle spring 19, the bush 28 is pressed with a biting edge 29 against the valve body 3. As a result, a control chamber 30, which is provided in the interior of the bush 28 and is defined by the end face, remote from the combustion chamber, of the nozzle needle 8, is sealed off from the nozzle spring chamber 20.

The control chamber 30 communicates with the nozzle spring chamber 20 via an inlet throttle 31. The control chamber 30 furthermore communicates with a relief chamber (not shown) via an outflow throttle 32. The communication of the control chamber 30 with the relief chamber depends on the position of a control valve member 33.

The injector shown in FIG. 1 functions as follows:

Via the fuel inlet 21, fuel subjected to high pressure reaches the nozzle spring chamber 20. From there, the fuel subjected to high pressure reaches the control chamber 30 on the one hand, via the inlet throttle 31, and the pressure chamber 24 on the other, via the bore 23. The ratios of the diameters are selected in a known way, such that as a consequence of the high pressure in the control chamber 30, the nozzle needle 8 is located with its tip 9 in contact with the nozzle needle seat. When the control valve member 33 opens, the control chamber 30 is pressure-relieved, and the nozzle needle tip 9 lifts from its seat. Then, fuel subjected to high pressure is injected through the injection ports 10 and 11 into the combustion chamber of the engine until such time as the control valve member 33 closes again. The consequence of that is that the pressure in the control chamber 30 rises again, and the nozzle needle 8 is pressed by its tip 9 back against the associated nozzle needle seat.

Figure 2:
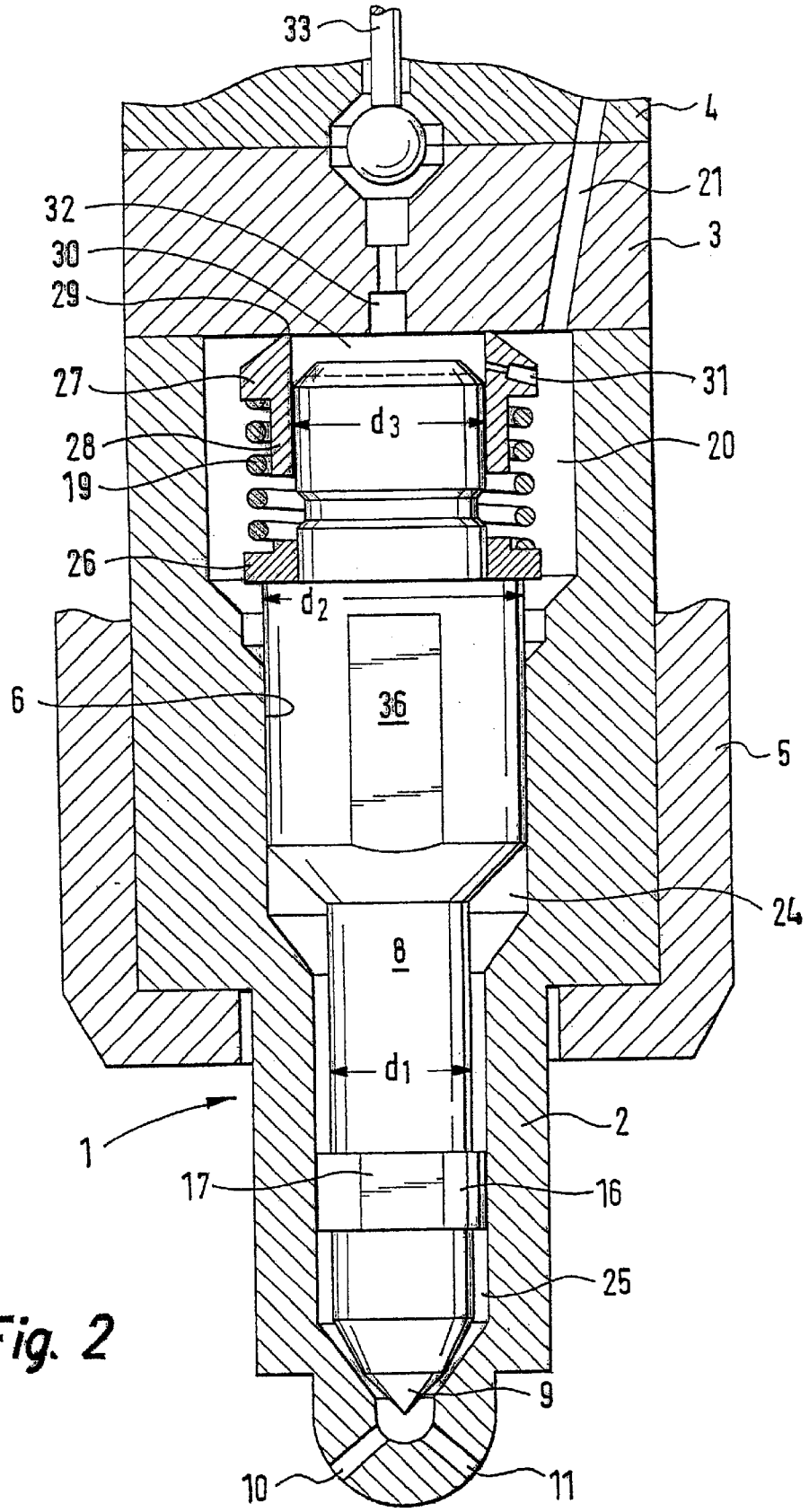
FIG. 2 is a view similar to FIG. 1 showing a second exemplary embodiment in longitudinal section through the injector, with a flat face on the nozzle needle between the nozzle spring chamber and the pressure chamber.

The second exemplary embodiment, shown in FIG. 2, is quite extensively equivalent to the first exemplary embodiment of the invention shown in FIG. 1. For the sake of simplicity, the same reference numerals are used to designate identical parts. In addition, to avoid repetition, reference is made to the above description of the first exemplary embodiment. Below, only the distinctions between the two exemplary embodiments will be addressed. The procedure will be analogous for the extensive description of the exemplary embodiments shown in FIGS. 3–11.

In the second exemplary embodiment shown in FIG. 2, a connecting bore between the nozzle spring chamber 20 and the pressure chamber 24 is lacking. Instead, a flat face 36 is embodied in the portion of the nozzle needle 8 that has the diameter $d_2$. The flat face 36 provides a communication between the nozzle spring chamber 20 and the pressure chamber 24. Otherwise, there are no distinctions between the two exemplary embodiments.

Figure 3:
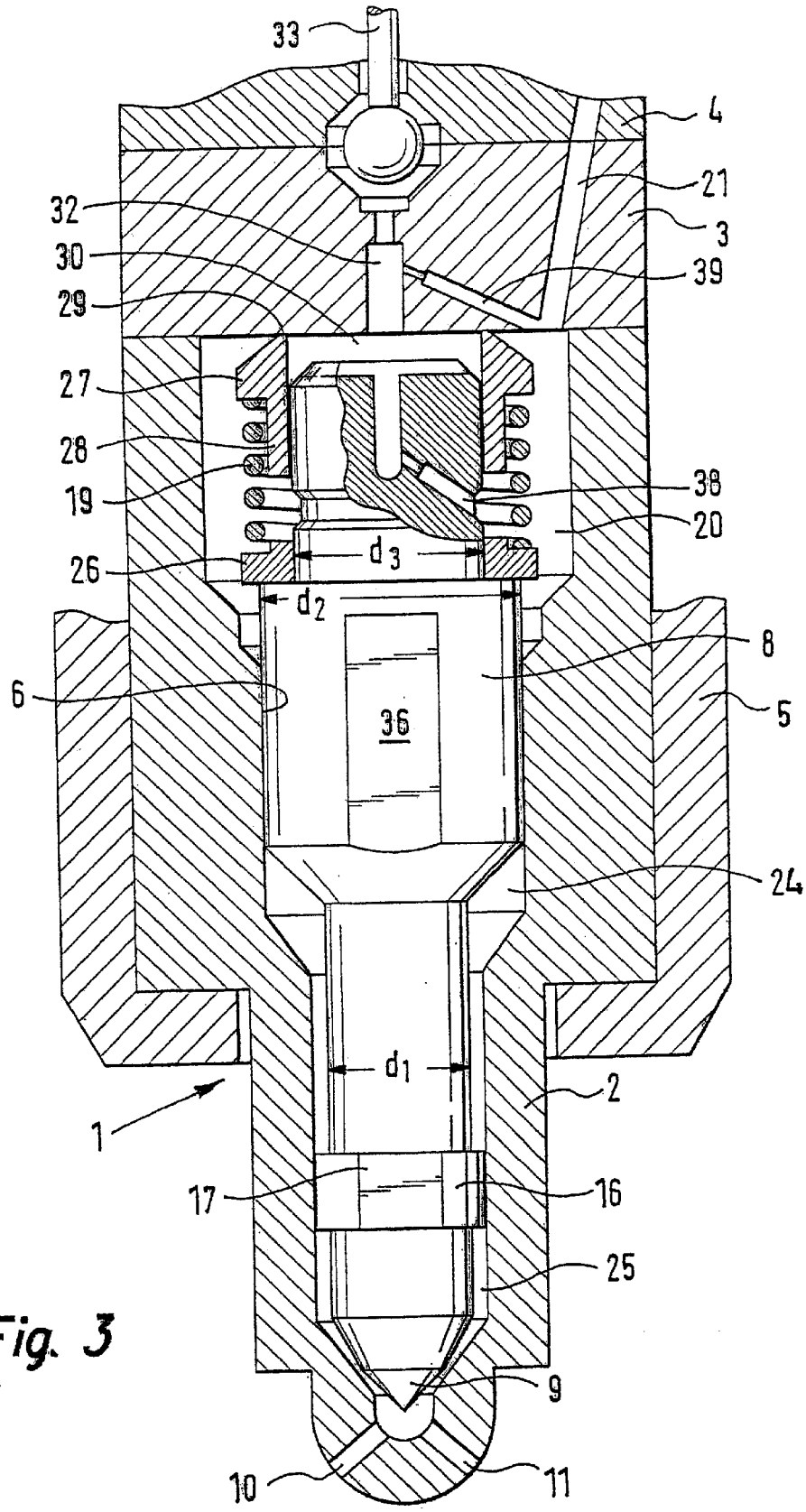
FIG. 3 shows a further exemplary embodiment in longitudinal section through the injector, with the inlet throttle integrated with the nozzle needle or with the injector housing.

The third exemplary embodiment shown in FIG. 3 differs from the second exemplary embodiment in that the inlet throttle is not disposed in the bush 28. Reference numeral 38 in FIG. 3 indicates that the inlet throttle can be integrated with the nozzle needle 8 in the form of bores of different orientations and different dimensions. Reference numeral 39 indicates that the inlet throttle can also be integrated with the valve body 3.

Figure 4:
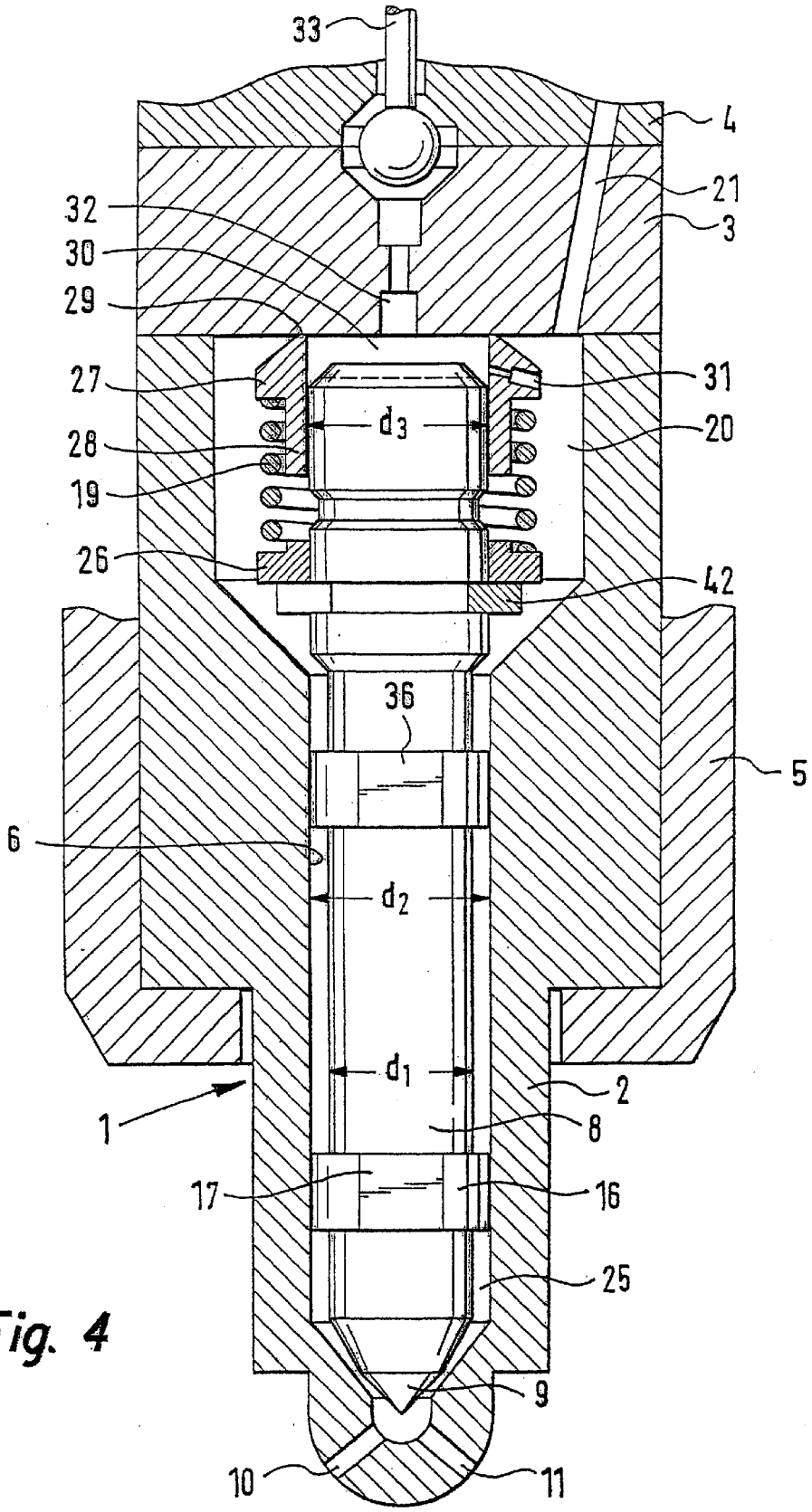
FIG. 4 shows a further exemplary embodiment in longitudinal section through the injector, in which the guide diameter is equal to the control diameter.

In the fourth exemplary embodiment shown in FIG. 4, the spring plate 26 is not braced directly on the nozzle needle 8 but rather only indirectly, via a resilient retaining ring 42 of rectangular cross section. To enable insertion of the retaining ring 42 into a circumferential groove embodied in the nozzle needle 8, the retaining ring 42 is embodied in split form.

Figure 5:
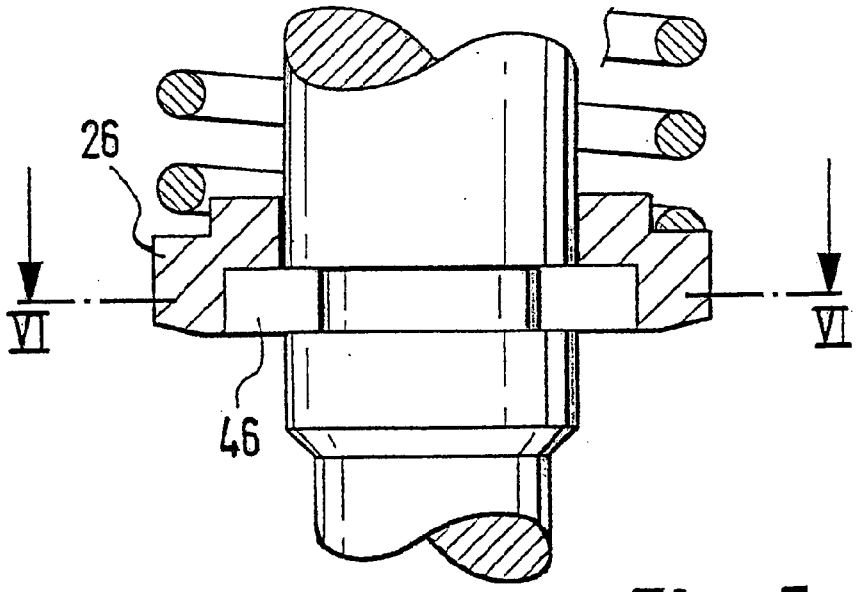
FIG. 5 shows a variant of the exemplary embodiment shown in FIG. 4, with a two-part retaining ring.
Figure 6:
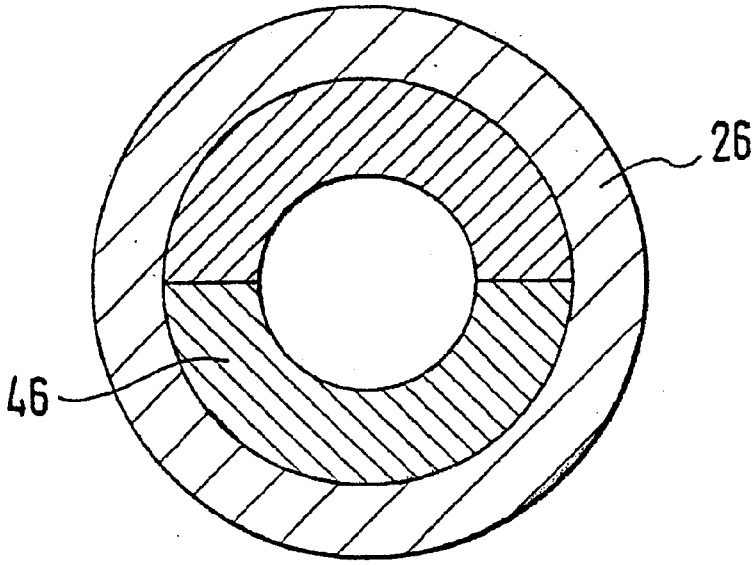
FIG. 6 is a section taken along the line VI—VI in FIG. 5.

In FIGS. 5 and 6, it is shown that instead of a single-part retaining ring that can be clipped on, a two-part retaining ring 46 can also be used. The retaining ring 46 comprises two ring halves, which are placed in the associated groove in the nozzle needle 8 and are fixed with the aid of the spring plate 26.

Figure 7:
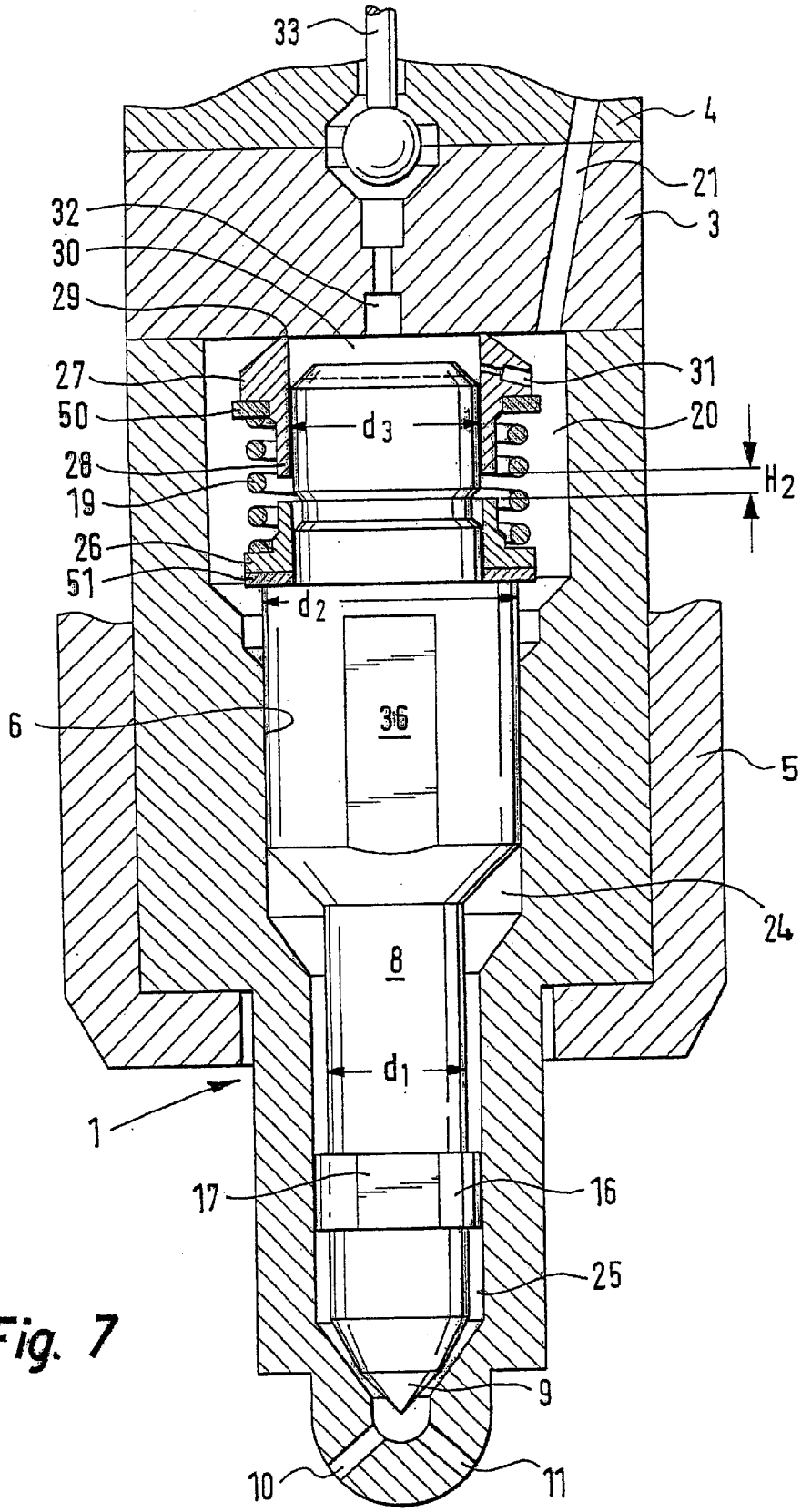
FIG. 7 shows a further exemplary embodiment in longitudinal section through the injector with spacer elements for adjusting the nozzle needle stroke and the nozzle spring prestressing force.

In the exemplary embodiment shown in FIG. 7, the stroke is not, as in the exemplary embodiment shown in FIG. 1, defined by the spacing $H_1$ of the end face, remote from the combustion chamber, of the nozzle needle 8 and the opposed face of the valve body 3, but rather by the spacing $H_2$ between the bush 28 and the spring plate 26. It can also be seen in FIG. 7 that the stroke $H_2$ can be adjusted by means of a spacer disk 51. To that end, the spacer disk 51 is disposed between the shoulder, which results from the difference in diameter between $d_2$ and $d_3$, and the spring plate 26. The spring prestressing force of the nozzle spring 19 can also be adjusted with the aid of a spacer disk 50. To that end, the spacer disk 50 is disposed between the nozzle spring 19 and the collar 27 of the bush 28. Because of these adjustment capabilities, hydraulic sticking or a complete exertion of pressure on the nozzle needle 8 in the control chamber 30 can be prevented. The result is better closing performance of the injector.

Figure 8:
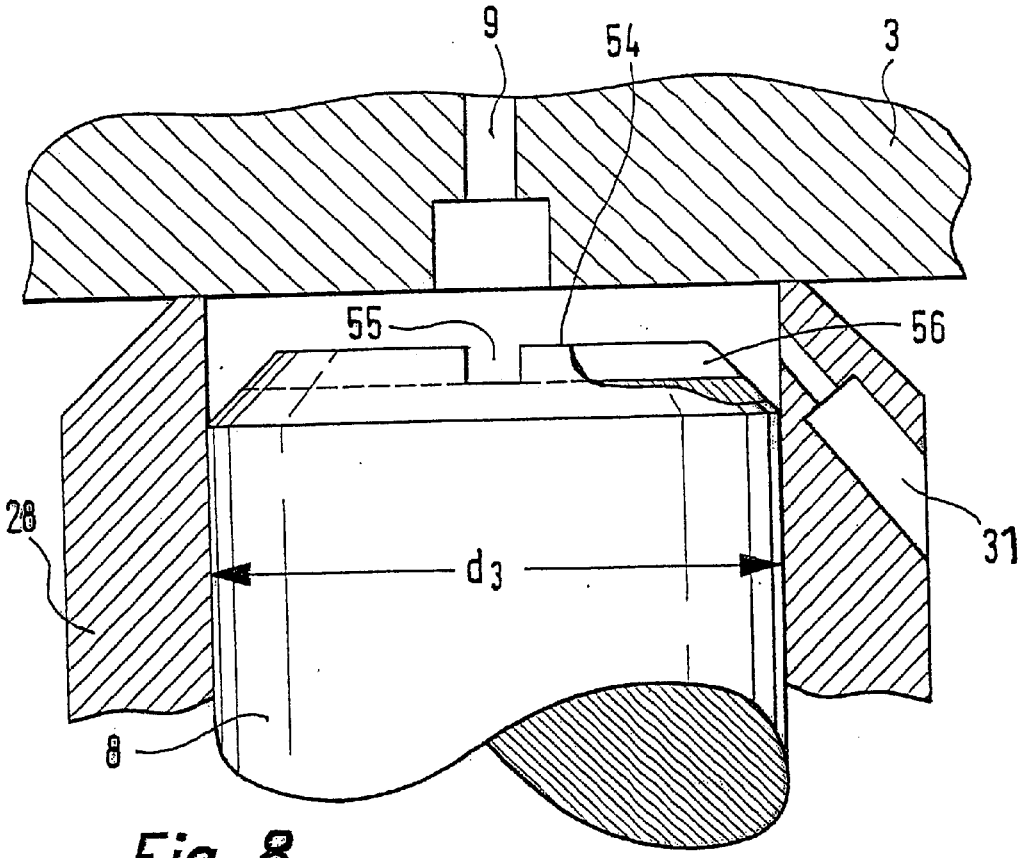
FIG. 8 shows a further exemplary embodiment in longitudinal section through the injector, with cross-type slots in the end face, remote from the combustion chamber, of the nozzle needle.
Figure 9:
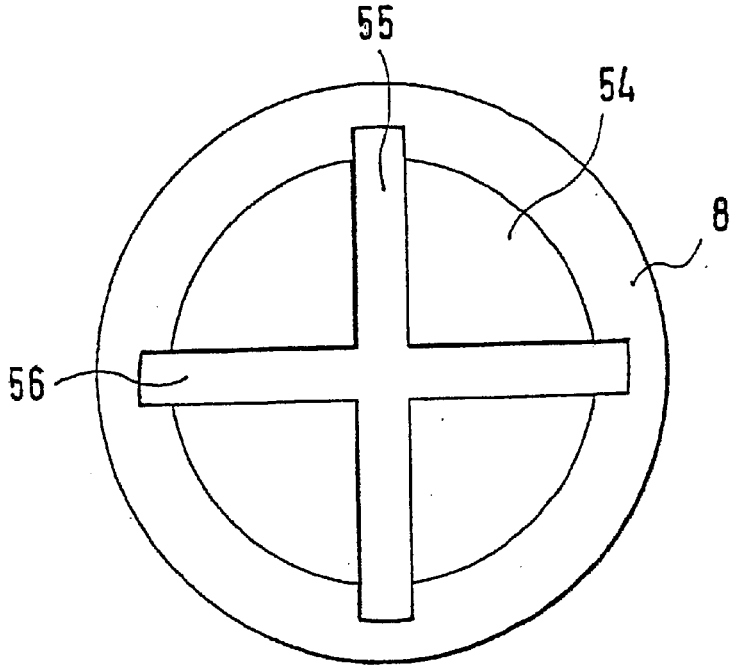
FIG. 9 shows the end face, remote from the combustion chamber, of the nozzle needle of FIG. 8, in plan view.

In the exemplary embodiments shown in FIGS. 8–11, the nozzle needle stroke is obtained, as in the exemplary embodiment shown in FIG. 1, from the spacing $H_1$ between the nozzle needle 8 and the valve body 3. To prevent the nozzle needle 8 in the open position from floating on a pressure cushion, the following proposals are offered:

In the exemplary embodiment shown in FIGS. 8 and 9, two grooves 55 and 56 are disposed intersecting one another in the end face 54 of the nozzle needle 8. As a result, a purely mechanical stop of the nozzle needle is achieved. If the dimensions of the grooves 55 and 56 are adapted to the injector, this can become a "semi-hydraulic stop". The open cross section that remains in the stop is selected to be precisely large enough that while vibration of the nozzle needle 8 is avoided, still the control quantity at the end stop is lowered as much as possible.

Figure 10:
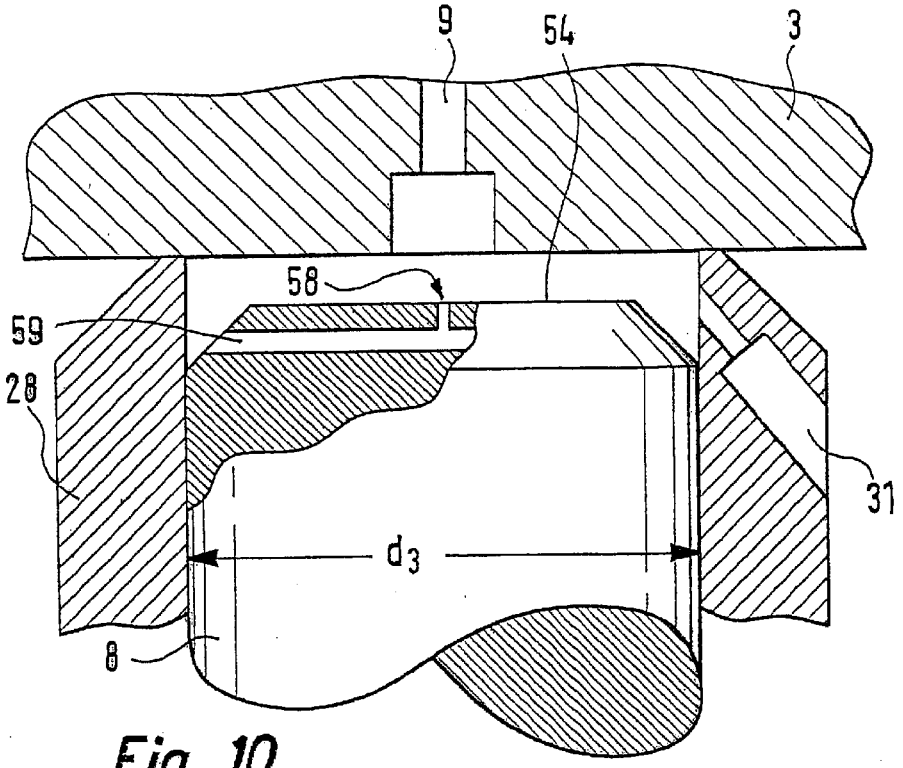
FIG. 10 shows a further exemplary embodiment in longitudinal section through the injector, with bores in the end face remote from the combustion chamber.

In the exemplary embodiment shown in FIG. 10, a throttle bore 58 is disposed, parallel to the longitudinal axis of the nozzle needle 8, in the end face 54 of the nozzle needle 8. The throttle bore 58 discharges into a bore 59 that extends transversely to the longitudinal axis of the nozzle needle 8. The bore 59 is a blind bore, which is open toward frusto-conical end, remote from the combustion chamber, of the nozzle needle 8. This exemplary embodiment has the advantage of being insensitive to mechanical running-in.

Figure 11:
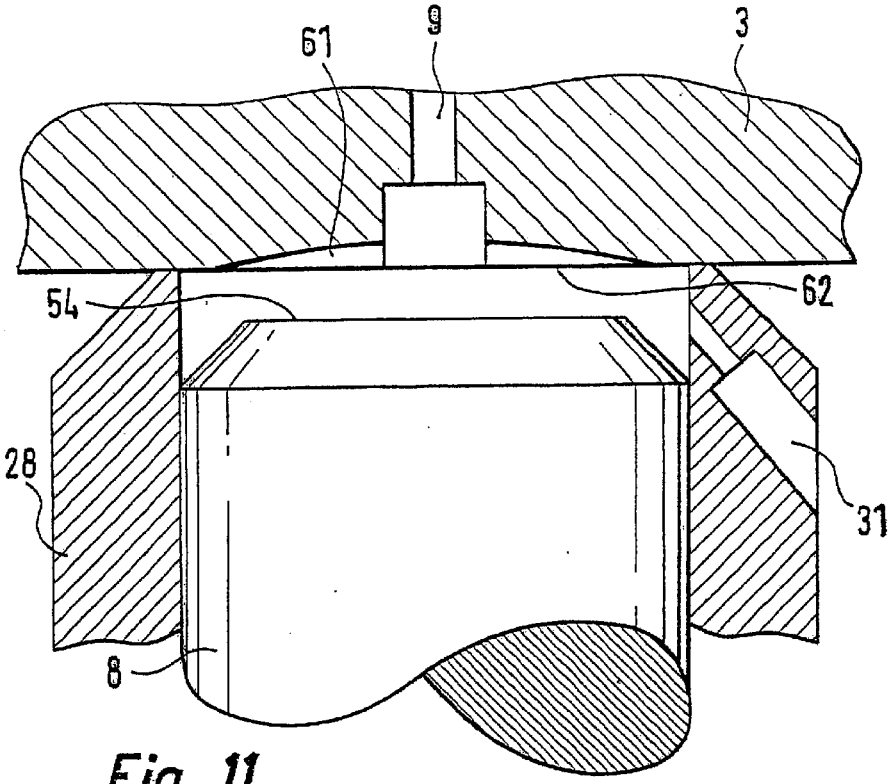
FIG. 11 is a further exemplary embodiment in longitudinal section through the injector, with a groove in the injector housing.

In the exemplary embodiment shown in FIG. 11, a groove 61 is recessed not in the end face 54 of the nozzle needle 8 remote from the combustion chamber but rather in the opposed face 62 of the valve body 3. The groove 61 has the same function as the grooves 55 and 56 in the exemplary embodiment shown in FIGS. 8 and 9.

The foregoing relates to preferred exemplary embodiments of the invention, it being understood that other variants and embodiments thereof are possible within the spirit and scope of the invention, the latter being defined by the appended claims.

We claim:

1. In a common rail injector for injecting fuel in a common rail injection system of an internal combustion engine, which system has an injector housing (1) with a fuel inlet (21) that is in communication with a central high-pressure fuel reservoir outside the injector housing (1) and with a pressure chamber (24) inside the injector housing (1), from which fuel subjected to high pressure is injected as a function of the position of a control valve (33) that assures that a nozzle needle (8) movable back and forth and received in a longitudinal bore (6) of the injector housing (1) axially counter to the prestressing force of a nozzle spring (19) that is received in a nozzle spring chamber (20), lifts from a seat when the pressure in the pressure chamber (24) is greater than the pressure in a control chamber (30) that communicates with the fuel inlet (21) via an inlet throttle (31, 38, 39), the improvement wherein the control chamber (30) is defined by a bush (28) that is displaceable, causing a sealing action, on the end of the nozzle needle (8) remote from the combustion chamber located outside the injector housing (1) and kept in contact against the injector housing (1) with the aid of the nozzle spring (19).

2. The common rail injector of claim 1, wherein a biting edge (29) is embodied on the face of the bush (28) that is in contact with the injector housing (1).

3. The common rail injector of claim 2, wherein that the inside diameter ($d_3$) of the bush (28) is less than or equal to a guide diameter ($d_2$) at the nozzle needle (8).

4. The common rail injector of claim 3, wherein the fuel inlet (21) communicates with the pressure chamber (24) via the nozzle spring chamber (20), and that the nozzle needle (8) is guided between the nozzle spring chamber (20) and the pressure chamber (24).

5. The common rail injector of claim 2, wherein the fuel inlet (21) communicates with the pressure chamber (24) via the nozzle spring chamber (20), and that the nozzle needle (8) is guided between the nozzle spring chamber (20) and the pressure chamber (24).

6. The common rail injector of claim 1 wherein the inside diameter ($d_3$) of the bush (28) is less than or equal to a guide diameter ($d_2$) at the nozzle needle (8).

7. The common rail injector of claim 6, wherein the fuel inlet (21) communicates with the pressure chamber (24) via the nozzle spring chamber (20), and that the nozzle needle (8) is guided between the nozzle spring chamber (20) and the pressure chamber (24).

8. The common rail injector of claim 1, wherein the fuel inlet (21) communicates with the pressure chamber (24) via the nozzle spring chamber (20), and that the nozzle needle (8) is guided between the nozzle spring chamber (20) and the pressure chamber (24).

9. The common rail injector of claim 8, wherein the nozzle spring chamber (20) communicates with the pressure chamber (24) via a bore (23).

10. The common rail injector of claim 8, wherein at least one flat face (36), past which fuel from the nozzle spring chamber (20) can reach the pressure chamber (24), is embodied on the nozzle needle (8) between the nozzle spring chamber (20) and the pressure chamber (24).

11. The common rail injector of claim 1, wherein the inlet throttle (31, 38, 39) is integrated with the bush (28), the nozzle needle (8) or the injector housing (1).

12. The common rail injector of claim 1, wherein the bush (28) has a collar (27) on its end remote from the combustion chamber.

13. The common rail injector of claim 1, wherein a step that forms a stop for a spring plate (26) is formed on the nozzle needle (8).

14. The common rail injector of claim 13, wherein the nozzle needle stroke ($H_2$) and the nozzle spring prestressing are adjustable with the aid of spacer elements (50, 51), which are disposed between the spring plate (26) and the stop for the spring plate, and between the nozzle spring (19) and the abutments for the nozzle spring (19).

15. The common rail injector of claim 1, wherein a circumferential groove is recessed out of the nozzle needle (8), and in this groove a retaining ring (42, 46) which forms a stop for a spring plate (26) is braced.

16. The common rail injector of claim 15, wherein the retaining ring (46) is in two parts, and in the assembled state it is fixed by the spring plate (26).

17. The common rail injector of claim 1, wherein the nozzle needle stroke ($H_2$) is defined by the spacing between the bush (28) and the spring plate (26).

18. The common rail injector of claim 1, wherein the nozzle needle stroke ($H_1$) is defined by the spacing between the end face (54), remote from the combustion chamber, of the nozzle needle (8) and the injector housing (1).

19. The common rail injector of claim 18, wherein recesses (55, 56; 61), whose dimensions are adapted to the volume of the control chamber (40), are provided in the end face (54), remote from the combustion chamber, of the nozzle needle (8) and/or in the opposed face (62) of the injector housing (1).

20. The common rail injector of claim 18, wherein in the end face (54), remote from the combustion chamber, of the nozzle needle (8) at least one axial bore (58) is provided, which communicates with at least one radial bore (59) in the nozzle needle (8).

* * * * *